United States Patent [19]

Bozek

[11] Patent Number: 4,649,891

[45] Date of Patent: Mar. 17, 1987

[54] CROSS BOW

[76] Inventor: John W. Bozek, 6093 Waterfront Dr., Waterford, Mich. 48095

[21] Appl. No.: 778,405

[22] Filed: Sep. 20, 1985

[51] Int. Cl.[4] ..... F41B 5/00

[52] U.S. Cl. ..... 124/25; 124/DIG. 1

[58] Field of Search ..... 24/23 R, 24 R, 35 R, 24/25, DIG. 1, 41 R

[56] References Cited

U.S. PATENT DOCUMENTS

| | | | |
|---|---|---|---|
| 1,375,990 | 4/1921 | Yorgensen | 124/25 |
| 1,827,023 | 10/1931 | Keseleff | 124/41 R |
| 1,914,449 | 6/1933 | Murray | 124/41 R |
| 2,842,114 | 7/1958 | Duncan | 124/35 |
| 2,963,016 | 12/1960 | Andis | 124/41 R |
| 3,028,851 | 4/1962 | Drake | 124/25 |
| 3,981,290 | 9/1976 | Islas | 124/DIG. 1 |
| 4,169,456 | 10/1979 | Van House | 124/25 |
| 4,201,182 | 5/1980 | Butler | 124/24 R |

*Primary Examiner*—Richard C. Pinkham
*Assistant Examiner*—Gary Jackson
*Attorney, Agent, or Firm*—John R. Benefiel

[57] ABSTRACT

An improved cross bow design is disclosed in which the prod is pivotally mounted to the stock for quick disassembly, and the drawstring nocking point is laterally constrained by a slider and track arrangement to insure coordinated prod limb flexing, and allow the plane of the bolt flight path to be spaced above and parallel to the plane of the drawstring and prod. Variable leverage devices are mounted on either side of the stock member drivingly interconnecting the drawstring and prod limb tips, with several embodiments set forth. Each variable leverage device includes rotary elements connected to a drawstring segment and one or more load cables in an opposing relationship to establish prod limb flexing by the drawstring with increasing leverage with advancing draw movement.

17 Claims, 19 Drawing Figures

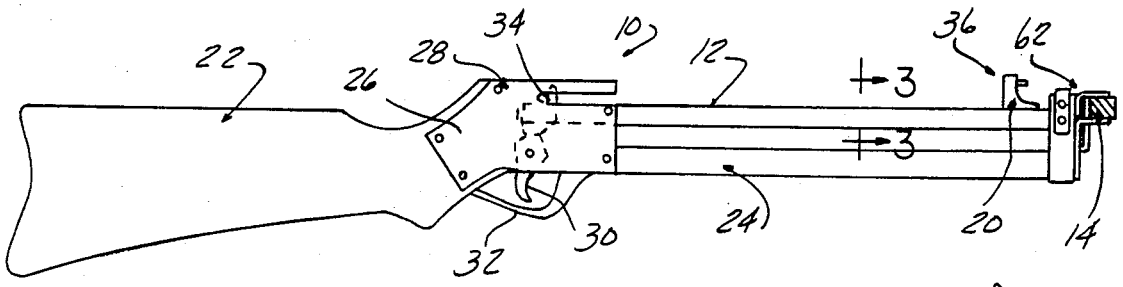
FIG-1
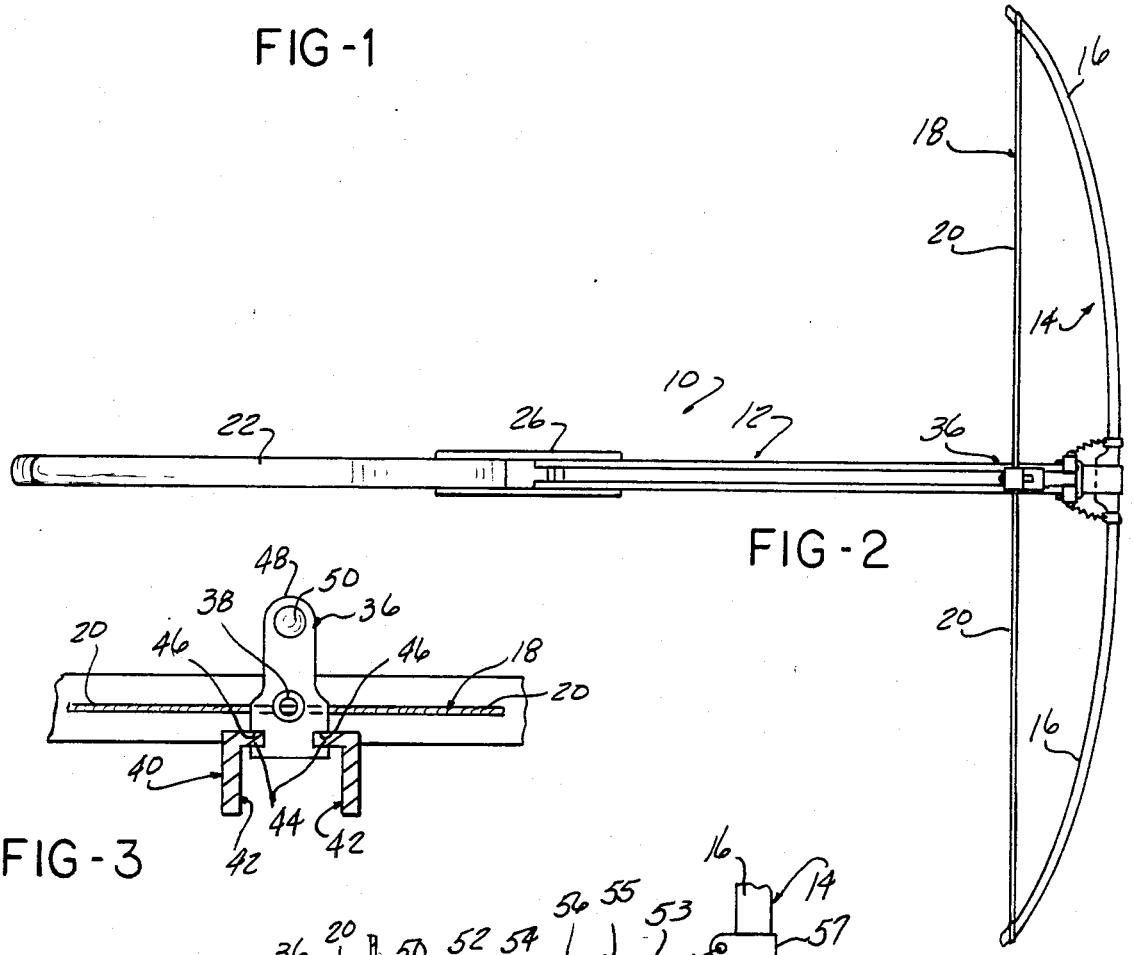
FIG-2
FIG-3
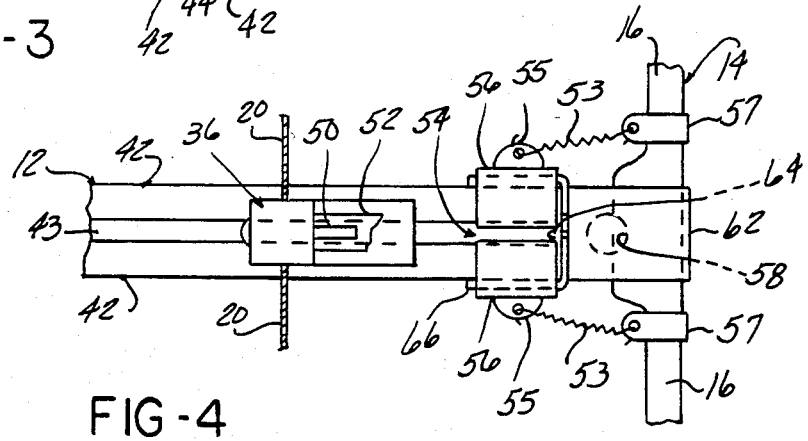
FIG-4

CROSS BOW

BACKGROUND OF THE INVENTION

This invention concerns archery devices and more particularly cross bows in which an elongated prod member is mounted transversely to a stock with a drawstring drawn rearwardly and held in a drawn or cocked position by a trigger mechanism.

BACKGROUND DISCUSSION

In conventional archery devices such as bows and cross bows, each limb of a bow member, (called a "prod" in cross bows) bends or flexes as the connecting drawstring is drawn and the stored potential energy is converted into kinetic energy of the arrow (referred to as a "bolt" in cross bows) as the drawstring and limbs move to the restored condition after release.

It is heretofore been recognized that uncoordinated bending of the respective bow or prod limbs can result in a less accurately controllable arrow flight.

The problem of uncoordinated limb flexing is most pronounced in the context of the so-called "compound" bows using variable leverage devices attached to the bow limb tips, utilizing rotary elements which allow a draw force drop off as the bow string moves to the fully drawn position in order to facilitate a steady aim and better acceleration characteristics at release.

Such a compound bow is described in the Allen U.S. Pat. No. 3,486,495. In such a construction, there is provided a pair of crossing load cables which by a cross leverage effect insures coordinated limb tip bending.

The presence of the crossing load cables is esthetically unpleasing and also tends to create an interfering obstacle for the arrow in the space between the drawstring and the bow member.

Other arrangements for insuring coordinated limb flexing have included a "figure eight" cable pattern passing around synchronizing wheels located adjacent the central grip.

It would be advantageous to eliminate such load cables from the space through which the arrow passes and also to eliminate the centrally disposed synchronizing mechanisms in the interest of simplicity.

In the context of cross bows, the prod contributes to the bulkiness and cumbersomeness of handling and stowage.

It would accordingly be advantageous if the length of the prod could be minimized, and if a quick disassembly were possible for transport and stowage of the crossbow. Pivotal mounting of the prod to allow a quick disconnect would tend to allow uncoordinated limb bending.

The length of the prod is determined in conventional constructions by the length of travel of the drawstring, since the tips must move correspondly to accommodate such travel.

Accordingly, it is an object of the present invention to provide an improved cross bow, in which coordinated flexing of the limbs is insured, while at the same time, the cross bow is easily disassembled by a pivotal mounting of the prod to the cross bow stock member.

It is another object of the present invention to provide variable leverage devices in a cross bow installation in which synchronized flexing of the limbs is assured, without the need for a plurality of crossing load cables, and/or the addition of special synchronizing mechanisms.

It is a further object of the present invention to provide an arrangement in which the draw distance is independent of the movement of the prod tips, such that a more rigid and therefore shorter prod member can be utilized.

SUMMARY OF THE INVENTION

These and other objects of the present invention which will become apparent upon a reading of the following specification and claims are achieved by a combination of a constrained drawstring with a pivotally mounted prod member. That is, means are provided for constraining the side-to-side movement of the mid or nocking point of the drawstring as it is released and travels to the restored position, such that the flexing of the respective prod limb tips is necessarily synchronized even though the prod is pivotally connected to the stock.

The drawstring may be constrained by being secured to a slider element disposed within a lengthwise track extending along the stock member.

Variable leverage devices drivingly interconnect each of the drawstring segments located on either side of the stock member with a respective prod tip.

In one version of a cross bow according to the present invention using variable leverage devices, the drawstring segments pass around pulleys mounted at either prod limb tip and are each connected to one of a pair of rotary variable leverage elements, each constituting a variable leverage device, each mounted at the forward end of one side of the stock member on a bracket affixed thereto. A load cable extends between each of the variable leverage rotary elements and to a respective prod tip such that load cables do not pass across the stock member, to lie in the path of the bolt.

In another embodiment the pulleys are eliminated and the drawstring segments are wrapped about the periphery of rotatably mounted curved arms each comprising a variable leverage device to which are also attached load cables extending to the prod limb tips. The curved arm rotary elements are mounted on brackets located on either side of the forward end of the stock member in this embodiment, thus eliminating the need for pulley elements at the prod limb tips.

In another variation, the variable leverage rotary elements are mounted to the stock member by spaced anchoring cable pairs connected at points aligned with the axis of rotation of the rotary element and to the side of the stock member. Corresponding pairs of load cables extend to the respective prod limb tip to respective rotary element. The associated drawstring segment is wrapped about the periphery of the respective curved arm. The use of cable pairs eliminates the need for rigid bracketry on the stock member by applying balanced forces to the rotary element.

In yet another embodiment, the variable leverage devices comprise swing out mounted lever arm pairs, each comprised of levers pinned together at one end, and the other end of one of the arms in each pair pivotally mounted on either side of the stock. A pair of load cables extend between the prod tip and an intermediate point on the one lever arm in each pair. The respective drawstring segments are attached to the other end of the free lever arm, which also has attached thereto a reaction cable fastened to the stock member.

The swing out mounting of the lever arm pairs enables extensive draw distance with minimal prod limb tip deflection, such that a short, rigid prod may be employed while still providing a substantial drawstring draw distance.

The pivotal mounting of the center of the prod, together with a track and slider to which the drawstring mid point is attached, allows the drawstring and prod to lie in the same plane, located beneath the bolt launch path to eliminate interference and to enable low friction mounting arrangements to be employed for the bolt, to minimize loss of energy and accuracy due to frictional contact with the bolt during launch.

The pivotal mount of the prod maximizes the flexing length of the prod, eliminates the complicated hardware which is necessary for the rigid attachment of the prod and allows ready takedown of the prod for stowage or travel.

These advantages are achieved without the loss of perfectly coordinated and balanced flexing of the respective prod limbs.

BRIEF DESCRIPTION OF THE DRAWINGS

FIG. 1 is a side elevational view of a cross bow incorporating the pivotal prod mount and drawstring constraint according to the present invention.

FIG. 2 is a plan view of the cross bow shown in FIG. 1.

FIG. 3 is a fragmentary view of the section 3—3 in FIG. 1.

FIG. 4 is an enlarged, fragmentary plan view of the cross bow shown in FIG. 2.

DETAILED DESCRIPTION

Figure 5:
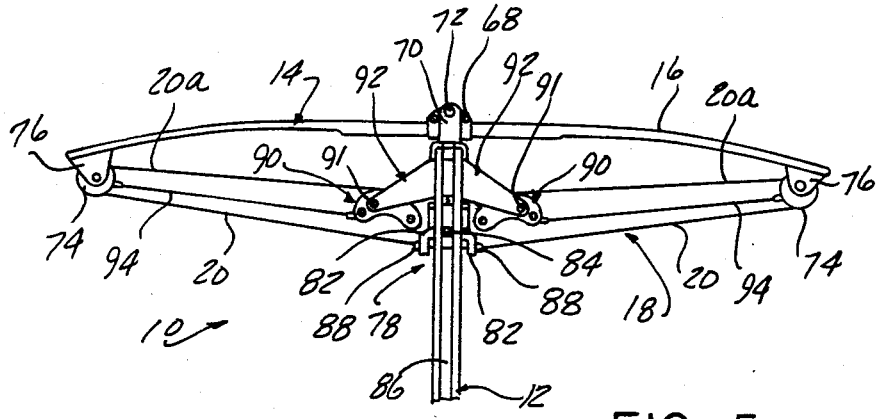
FIG. 5 is a plan view of an alternate embodiment of the cross bow according to the present invention incorporating variable leverage devices.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to FIG. 1, the cross bow 10 according to the present invention includes an elongated stock member 12, having mounted at forward end, an elongated prod 14 extending transversely thereto in conventional fashion.

Attached to each limb tip 16 of the prod 14 is a drawstring 18, comprised of drawstring segments 20 extending from the limb tips 16 to the stock member 12.

The stock member 12 includes a butt 22 adapted to be positioned against the shoulder of the user in conventional fashion, and also includes a stock frame 24 secured to the butt piece 22 by means of mounting plates 26 disposed on either side thereof. The mounting plates 26 also house a trigger mechanism 28 which may be of conventional construction, including a trigger 30 housed within trigger guard 32.

The trigger mechanism 28 includes a catch 34 adapted to hold the fully drawn drawstring 18, in cocked position and to controllably release the same in order to fire the cross bow, in conventional fashion.

According to the concept of the present invention, the drawstring 18 is mounted such as to be constrained against side-to-side movement during travel of the drawstring midpoint after being released. This is achieved by providing a drawstring slider element 36. The drawstring 18 passes through the slider element 36 and is fastened as by means of a threaded retainer element 38 received within a threaded bore in the slider element 36, such that side-to-side movement, with respect to the slide is precluded.

The slider element 36 itself is mounted for constrained lengthwise movement by means of a track 40, comprised of rail member 42 forming a part of the stock frame 12 and having horizontally extending lip portions 44 received within recesses 46, on either side of the slider element 36.

Accordingly, the drawstring 18 is drawn to the rear by gripping of the slider element 36, and the slider element 36 is held and released by the trigger mechanism 28 at firing.

The slider element 36 includes an upper protuberance 48 which carries an engagement pin 50 configured to be received within a corresponding socket in the bolt, the rear portion thereof shown at 52 in FIG. 4.

The engagement pin 50 is aligned at the same elevation as a forward guide slot 54 defined by a pair of flange elements 56, the slot 54 being centered on the track 43, but above the level of the drawstring 18. This arrangement minimizes the frictional contact of the crossbow part surfaces with the bolt 52, such as to improve the efficiency of the conversion of potential energy of the flexed prod 14 into kinetic energy of the bolt 52 upon firing.

According to a second aspect of the concept according to the present invention, the prod 14 is pivotally mounted such as to insure perfect "tuning" or symmetrical flexing of the prod limbs 16, while enabling a ready takedown of the cross bow 10 by removal of the prod 14.

In its simplest form, as shown in FIG. 4, an arcuate relief 58 is formed in the in rear side of the prod 14 at its midpoint, and a corresponding pivot pin 60 is carried in a clevis frame 62, secured as by screw 64 to a channel member 66, forming the nose of the stock frame 24, pin 60 being adapted to be interfit into relief 58. Attachment springs 53 are hooked over brackets 55 and bands 57.

It can be seen that substantially the entire length of the prod 14 is flexed by the tension of the drawstring 18, upon drawing thereof, to minimize the overall length necessary to achieve a given draw force. It can also be appreciated that the dismantling can be achieved very simply, by simply withdrawing the prod 14 from the clevis 62, after unstringing the drawstring 18 from the tips of the prod and unhooking springs 53 from bands 57.

At the same time, perfectly tuned performance is insured due to the side-by-side constraint of the position of the nocking point, when combined with the free pivoting mounting of the prod 14, which balances out the flexing of each limb 16.

It may also be appreciated that the drawstring 18 and the prod 14 may lie in the same plane throughout the movement of the drawstring 18 after release, the plane being at a lower level than, and parallel to the flight path of the bolt 52, such that any potential interference therewith is precluded.

This "tuning" action created by the pivotal mounting of the prod 14 together with the constrained movement of the drawstring 18 midpoint, enables the adaptation of variable leverage devices without the need for cables crossing through the stock member, nor the need for separate synchronizing devices.

Figure 6:
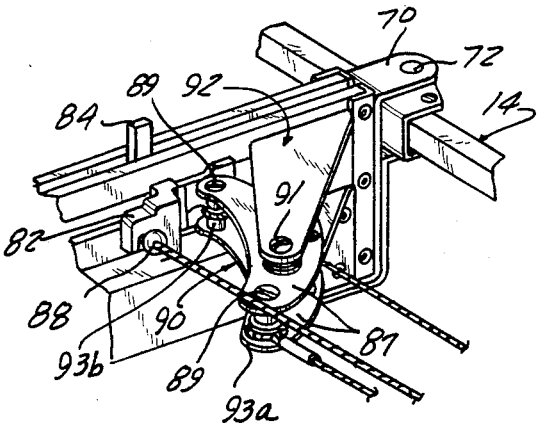
FIG. 6 is a fragmentary perspective view of portions of the cross bow shown in FIG. 5.
Figure 7:
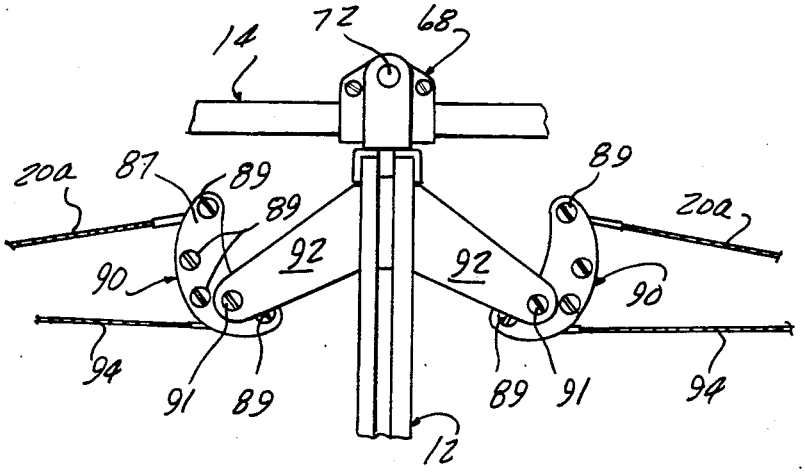
FIG. 7 is a fragmentary plan view of the cross bows shown in FIGS. 5 and 6, depicting the position of the variable leverages devices with the drawstring in a drawn position.

An embodiment of the cross bow according to the present invention incorporating such variable leverage devices is shown in FIGS. 5 through 7. The prod 14 is pivotally mounted at its midpoint at the forward end of the stock member 12, as in the above described embodiment. In this embodiment, a bracket 68 is provided attached to the prod midpoint, with the bracket 68 mounted within a clevis 70 by means of a quick release pin 72.

In this embodiment, a pair of pulley wheels 74, and clevis brackets 76 are mounted at the tip of each limb 16 of the prod 14.

The drawstring 18 includes segments 20 each extending from a slider 78 having left and right hand portions 80 and 82, and a central bolt engaging protruberance 84 received within track 86, formed lengthwise along the length of the stock member 12.

The drawstring 18 is secured side to side by means of stops 88 affixed thereto preventing such lateral movement of the drawstring 18 with respect to the stock member 12. The drawstring segments 20 each pass around the respective pulleys 74, and extend back towards the stock member 12, and are anchored to variable leverage elements 90, each constituting a variable leverage device, pivotally mounted at 91 on either side of the stock member 12 in clevis anchors 92.

Also provided are respective load cables 94, secured at one end around a spacer 93 located on the outboard end of the rotary elements 90, and at the other end around the axle of the respective pulley 74, as shown in FIG. 5. The rotary elements 90 are comprised of curved arms made up of a pair of spaced curved plates 87, secured together by screws 89 and spacers 93. The point of attachment of the inner drawstring segments **20*a* is around spacer 93*b*, located on the other side of the pivotal mounts 91, such as to create an opposing leverage, created by tension on the drawstring 18 acting to flex the respective limbs 16** when drawn to the rear.

The variable leverage elements 90 comprised of curved arms as indicated, such that as the rotation of the rotary variable leverage elements 90 proceeds with the unwrapping of the drawstring segments 20, the leverage generated by the tension of each drawstring segment 20 acting on the load cables 94 increases as shown in FIG. 7. That is, the effective lever arm length about pivot axis 91 increases as the rotary element 90 is rotated about the pivot point 91 as the drawstring slide 78 is moved to the rear and rotation of the elements 90 occurs, as seen in FIG. 7. This thus affords a variable leverage feature, in that a reduced force is required as the drawstring 18 moves the fully drawn position.

As will be appreciated by those skilled in the art, the use of the variable leverage devices reduces the stress on the catch mechanism, allows the use of a shorter prod, and results in the more effective acceleration of the bolt.

To eliminate the pulleys 74, and associated hardware, the drawstring 18 may be directly attached to the rotary elements.

Figure 8:
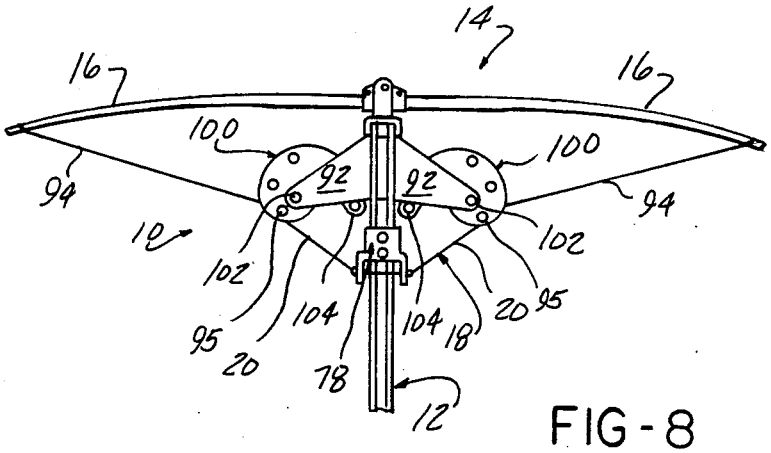
FIG. 8 is a plan view of another embodiment of the cross bow according to the present invention.
Figure 9:
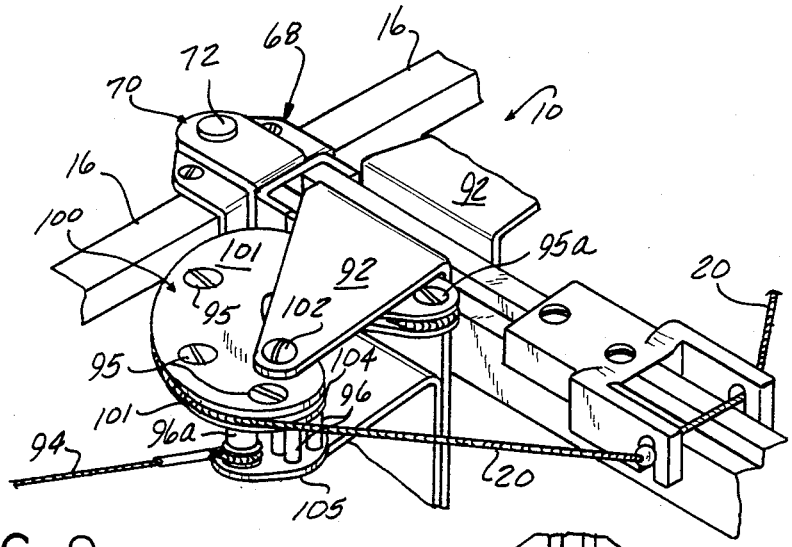
FIG. 9 is a fragmentary perspective view of portions of the cross bow shown in FIG. 8.
Figure 10:
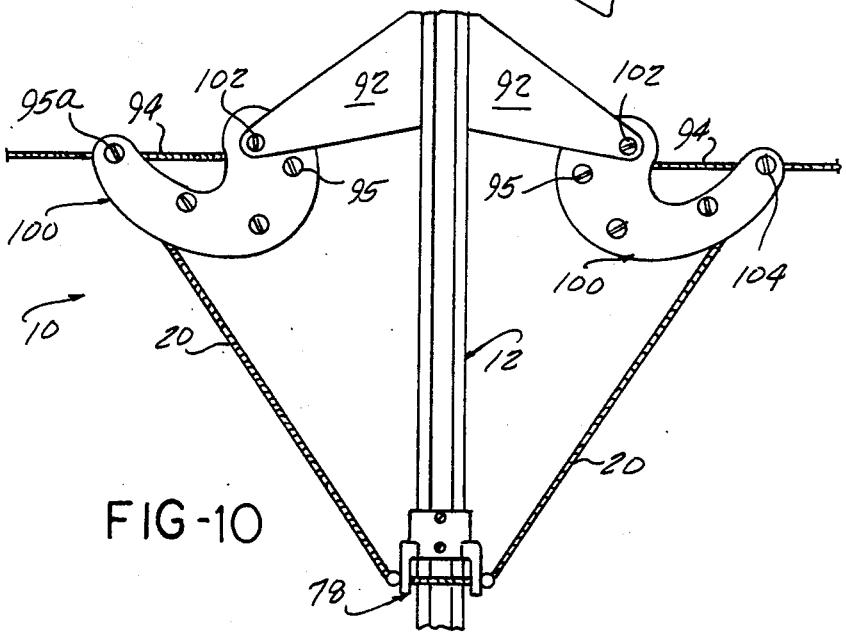
FIG. 10 is a fragmentary plan view of the cross bows shown in FIGS. 8 and 9 illustrating the position of the variable leverage devices with the drawstring in the drawn position.

A further embodiment of the present invention is shown in FIGS. 8 through 10, illustrating just such an arrangement. In this instance, relatively large curved arm rotary elements 100 are provided, each comprising the variable leverage devices pivotally mounted at 102 in U-shaped clevis brackets 92 affixed to either side of the stock member 12. Each curved arm rotary element 100 is comprised of curved plates 101 sandwiching a grooved sheave member 104, held together by screws 95.

A third plate 105 is mounted thereto offset below by spacers 96, and load cables 94 are attached by being looped around spacer 96.

The drawstring segment 20 wraps around the periphery of the sheave member 104 of curved arm rotary element 100, to a point of attachment to screw **95*a* located at the "tail" portion of the respective rotary element 100, so that the tension exerted by the drawstring segments 20 is in opposition to that exerted by the load cables 94**.

Sheave members 104 enable smooth wrapping and unwrapping of the cable segments as rotation of the rotary elements 100 occurs.

It will be appreciated that as the slide element 78 is drawn to the rear, a torque is exerted on the rotary elements 100 tending to rotate them against the opposing tension of the load cables 94. This causes flexing of the limbs 16 of the prod 14, by virtue of the connection of the load cables 94 to the tips thereof.

As the rotary elements 100 rotate, drawstring segments 20 lengthen in a direction extending to the rear of the cross bow 10, as additional portions of segments 20 unwrap from the grooved perimeter of the sheave members 104. As such unwrapping proceeds, it can be seen that the leverage able to be exerted by the drawstring segments 20 increases, in that the effective lever arm able to be exerted by the drawstrings 20 acting about the pivot point 102 increases, while the effective lever arm able to be exerted by the load cables 94 decreases. Thus, a pronounced variable leverage action is produced, reducing the force required to be exerted on the drawstring segments 20 in order to counteract the force exerted by the load cables 94, and the flexing of the prod limbs 16.

It is also noted that in order to produce a sufficient perimeter distance for adequate travel of the slide 78, the size of the rotary variable curved arm element 100 must be relatively large.

Figure 11:
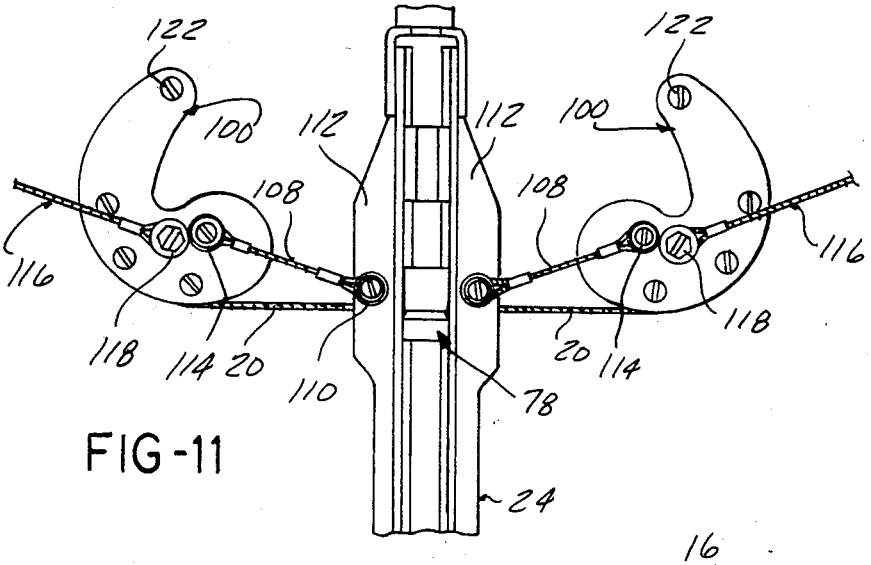
FIG. 11 is a fragmentary plan view of another embodiment of the cross bow according to the present invention.

It also will be noted that in both of the last described embodiments, substantially rigid clevis brackets must be provided, since tilting forces act on the rotary elements due to the offsetting of the drawstring segments and the load cables. Such rigid brackets 92, may be eliminated by another rearrangement of drawstring segments and load cables, as seen in the embodiment illustrated in FIGS. 11 through 13.

In this instance, the rotary elements 100 each constituting a variable leverage device, are mounted to the stock member 12 by means of straddling pairs of anchor cables 108, anchored at one end by means of screws 110, received in respective vertically spaced flanges 112, comprising a part of the stock frame member 24. Anchor cables 108 are secured at their other respective ends to the rotary elements 100 on posts 114, defining an axis of rotation of the rotary variable leverage elements 100.

Straddling pairs of vertically spaced load cables 116 are also provided, connected to the respective tips of limb 16 of the prod 14, and to connection points 118 on either side of the rotary elements 100. The use of straddling pairs of load cables 116 and anchor cables 108 insures that significant tipping forces will not be imposed on the rotary elements 100, such as to eliminate the need for rigid bracket mounting of the rotary element 100.

Figure 12:
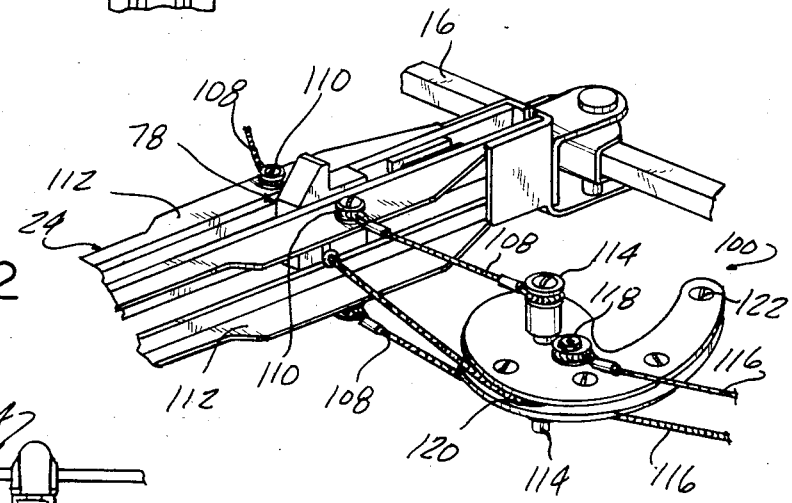
FIG. 12 is a perspective view of fragmentary view of portions of the cross bow shown in FIG. 11.

The drawstring segments 20 pass about the periphery of sheave members 120 of the rotary elements 100, as seen in FIG. 12, and anchored around screws 122, located at the tail end of rotary elements 100.

Figure 13:
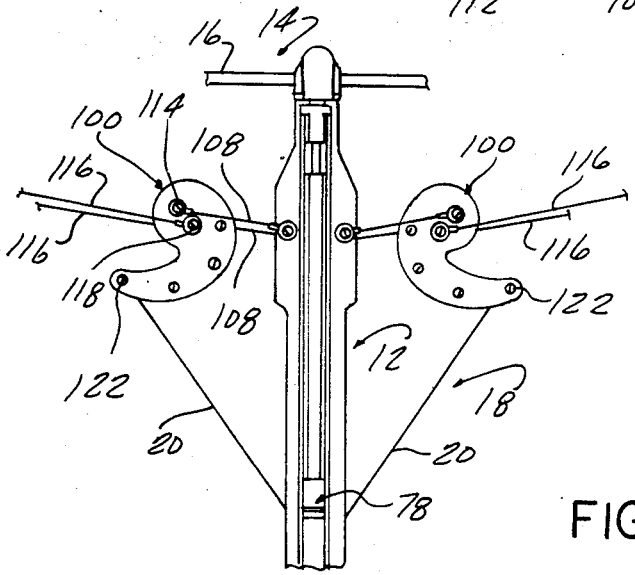
FIG. 13 is a fragmentary plan view of portions of the cross bow shown in FIGS. 11 and 12, illustrating the variable leverage devices with the drawstring in the drawn position.

In the above described embodiment, as the drawstring segments 20 are moved to the rear by drawing movement of the slide element 78, tension is generated to exert a rotary torque on the rotary elements 100, tending to pivot them about pivot points defined by pivot connections 114, as seen in FIG. 13.

The rotation of elements 100 in turn acts on the load cables 116 to flex the tips of the limb 16 of the prod 14.

Increasing leverage is able to be exerted by the drawstring segments 20 with increasing rotation of the rotary element 100 due to the eccentric perimeter configuration thereof, as seen in FIG. 13, such that the drawing force is reduced as the drawstring segments 20 are moved to the full drawn position.

In the embodiments in FIGS. 8 through 13, the drawing motion of the drawstring segments 20, and flexing motion of the prod limbs 16, are not directly related in the sense that there is a direct correspondence of movement therebetween, since the drawstring segments 20 are not attached to the tips of the prod limbs 16. Stated another way, the necessary drawstring 18 slack to accommodate rearward slide movement is generated by unwinding from the rotary elements 100 rather than flexing of the limbs 16. Thus, as noted above, the size of the rotary elements 100 must be relatively great in order to accommodate sufficient travel of the slider element 78 and drawing movement of the drawstring movement of the drawstring 18 to allow sufficient travel of the drawstring 18 in contact with the bolt, to provide adequate transfer of potential energy into kinetic energy of the bolt, as will be appreciated by those skilled in the art.

Figure 14:
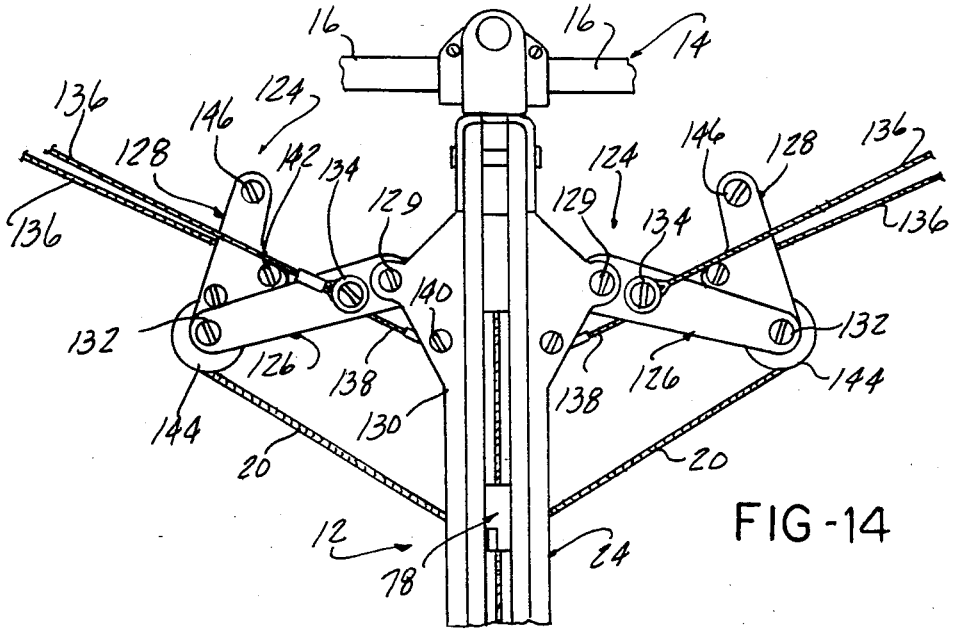
FIG. 14 is a plan view of another embodiment of the cross bow according to the present invention.
Figure 15:
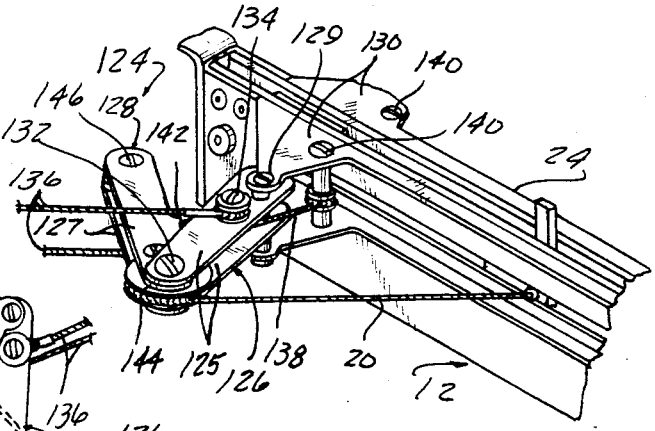
FIG. 15 is a fragmentary perspective view of portions of the cross bow shown in FIG. 14.
Figure 16:
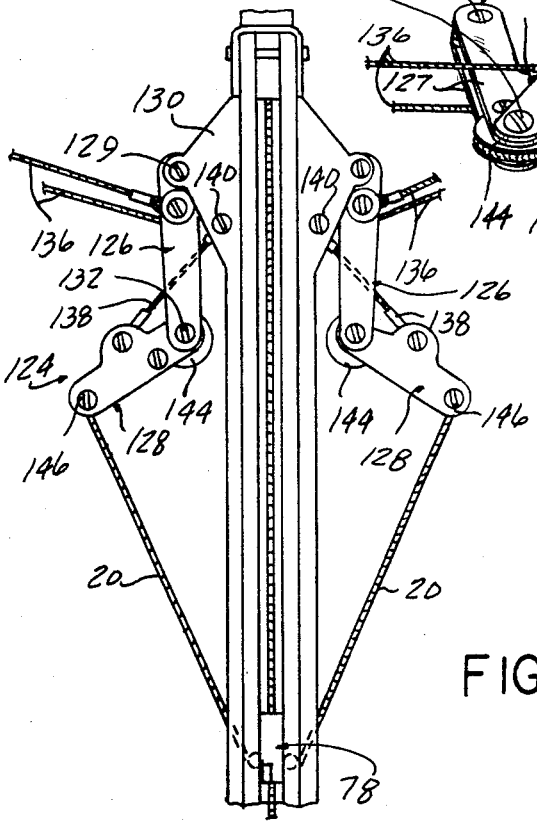
FIG. 16 is a fragmentary plan view of the cross bow shown in FIGS. 14 and 15, illustrating the variable leverage devices with the drawstring in the drawn position.

The embodiment according to FIGS. 14 through 16, provides an arrangement for allowing generation of adequate slack in the drawstring segments without the need for large diameter rotary curved arm elements.

In this last embodiment, the variable leverage devices 124 are comprised of a pair of pivotally connected lever arms 126 and 128, each comprised of spaced plates 125 and 127 respectively. The inner, first lever arm 126 is pivoted at 129 to a flange 130 conforming a part of the stock member frame 24. The inner lever arm 126 is pinned at 132 at its other end to the second, outer lever arm 128.

Connected to the inner first lever arm 126 at a point 134 intermediate the length thereof, is one end of a pair of load cables 136, cables 136 connected at their other ends to the tip of the respective prod limbs 16.

The second, outer lever arm 128 is mounted intermediate the spaced plates 125 of the inner lever arm 126, each constituted. Passing through the intermediate space between plates 125 is a reaction cable 138 anchored at 140 to the flange 130 at one end, and at the other end to the second outer lever arm 128 at 142.

Pulley guides 144 are pivotally mounted to rotary devices 124 by pivot connection 132 located at the point around which each drawstring segment 20 passes in the undrawn position, and extends to the free end of second lever arm 128, to a point of connection defined by screw 146.

As the drawstring segments 20 are placed under tension upon drawing of the slide element 78, a torque is generated acting on inner lever arm 126 and outer lever arm 128 tending to rotate the same about their respective pivot points.

The rotation of lever arm 128 about its respective pivot 132 is restrained by reaction cable 138, such that rotation of the inner lever arm 126 primarily occurs as the drawstring segments 20 are moved to the rear. The rotation of the inner lever arm 126 about pivot axis 129 produces limb tip flexing via the action of attached load cables 136.

As rotation of the inner lever arms 126 proceeds, the leverage able to be exerted by the drawstring segments 20 to produce rotation of the inner lever arm 126 increases, to thereby produce the variable leverage effect.

It can be appreciated that an unfolding action is created by the rotation of the inner lever arm 126 and outer lever arm 128, generating substantial drawstring slack. It is for this reason that a very short stiff prod 14 may be employed with this design, since only a slight flexing motion of the prod limb 16 will generate a disproportionate travel of the slide element 78, such as to provide adequate draw length for good performance characteristics.

Figure 17:
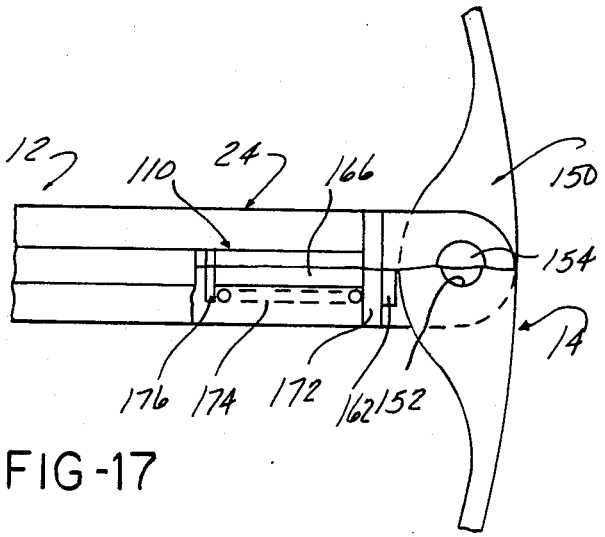
FIG. 17 is a fragmentary plan view of an alternate arrangement for mounting of the prod to the stock member.
Figure 18:
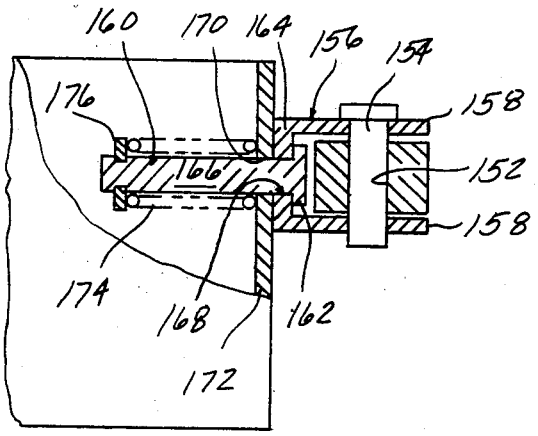
FIG. 18 is a fragmentary sectional view of portions of the arrangement shown in FIG. 17.
Figure 19:
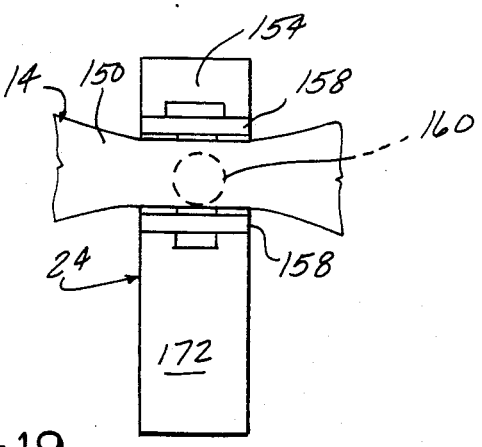
FIG. 19 is a fragmentary front elevational view of the portions of the arrangement shown in FIGS. 17 and 18.

Alternate arrangements for mounting of the prod 14 to the stock member 12 may be employed, as shown in FIGS. 17–19.

In the embodiment illustrated therein, the prod 14 is formed with a central mounting section 150, thickened in the plane of the drawstring motion, but of reduced thickness transversely, as seen in FIGS. 17 and 19 respectively. A bore 152 is machined through section 150 to allow a quick release pin 154 to pass therethrough and thereby connect the prod 14 to a clevis 156 having spaced plates 158 extending on either side of section 150.

The clevis 156 is mounted for limited travel by a attachment pin 160 having and head 162 sealing on cross plate 164 of clevis 156, and having a stem 166 passing through bores 168 and 170 of cross plate 164 and nose plate 172 of stock frame 24.

A spring 174 is seated against a retainer 176 and the inside of nose plate 172.

Thus, the clevis 156 and prod 14 may move to the right after firing against the bias of spring 174 to act as a shock absorber, to reduce the shock as the limbs 16 snap to the relaxed position.

At the same time, a simplified mounting arrangement is provided, eliminating the need for a separate prod mounting bracket.

Accordingly, it can be appreciated that the above recited objects of the present invention have been achieved by the present invention in that a perfectly tuned cross bow is provided by the constrained drawstring and pivotal prod mount, and also allows a quick disassembly of the prod from the stock member in order to provide convenient stowage and transport.

Similarly, the use of the track and slide arrangement enables the drawstring and prod to move in the same plane, below the plane through which the bolt moves during launch, such as to allow minimum friction arrangements, and simplified mounting of the various components.

Additionally, this arrangement provides a very advantageous incorporation of variable leverage devices into the cross bow design, eliminating the need for crossing or synchronizing cables or other devices and minimizing the mass of components necessary to be carried by the prod limb tips.

It is noted that many variations of the above described embodiments are possible within the scope of the following claims. For example, while it is advantageous to mount the variable leverage devices to the stock members to minimize the mass carried by the prod limb tips, these could of course also be mounted on the limb tips.

The specific arrangements of variable leverage devices provide a advantageously simple arrangement free from the crossing synchronizing cables or other elements, and as to the last described embodiment, enable a relatively great drawstring travel for minimum flexing motion of the cross bow to thereby allow a short stiff prod to be used to produce a relatively compact structure.

I claim:

1. A crossbow for projecting bolts comprising:

an elongated stock member including a forward end and a butt end for holding by a user;

an elongated flexible prod having a tip at either end thereof;

pivot means pivotally mounting the mid point of said prod at the forward end of said stock member to allow free pivoting movement of said prod with respect to said stock member during drawing and firing of said crossbow, said stock and prod members extending transversely to each other;

a drawstring having a pair of segments extending away from either side of said stock member, and towards said prod tips;

means drivingly connecting one end of each of said drawstring segments to a respective prod tip so as to cause movement of said prod tips rearwardly as the other end of each of said drawstring segments is drawn to the rear, thereby causing flexing of said prod member;

track means extending along the length of said stock member receiving said other end of each of said drawstring segments;

means constraining side-to-side movement of said other end of each of said drawstring segments with respect to said track means as said drawstring is drawn;

trigger means for receiving said other end of each of said drawstring segments as said drawstring is moved to a full draw position, and allowing selective release thereof for projecting bolts therefrom.

2. The cross bow according to claim 1 wherein said means for drivingly connecting one end of each segment of said drawstring to a respective prod tip includes a respective variable leverage device comprised of a rotary element connected to said one end of a respective drawstring segment so as to be rotated by drawing of said drawstring, including means drivingly connecting said each rotary element to a respective prod tip to cause increased flexing of said prod tips with rotation of said rotary element;

each of said devices configured to create a reduced force acting on a respective drawstring segment as said drawstring is moved to the fully drawn position and said devices are rotated to fully flex said prod tips.

3. The cross bow according to claim 2 including means rotatably mounting one of said rotary variable leverage devices on either side of said stock member.

4. The cross bow according to claim 3 wherein said means for drivingly connecting each of said prod tips to a respective rotary element includes a load cable connected to said rotary element to cause said prod flexing by said rotation of said rotary element so that increasing leverage is able to be exerted by said respective drawstring segment with increasing rotation of said rotary element.

5. The cross bow according to claim 2 wherein said means rotatably mounting said variable leverage devices comprises rigid bracket means affixed on either side of said stock member.

6. The cross bow according to claim 2 further including a pulley mounted to each prod tip, and wherein each of said drawstring segments pass around a respective pulley and extend to be connected at a point on a respective rotary element.

7. The cross bow according to claim 2 wherein each of said rotary elements comprise an arm having a curved perimeter and mounted for rotation about an axis extending transversely to a plane formed by said prod member and said stock member and wherein said respective drawstring segment is connected to be wrapped around said arm perimeter by rotation thereof.

8. The cross bow according to claim 7 wherein said arm perimeter defines a varying radius about said axis of rotation to produce said varying leverage.

9. The cross bow according to claim 8 wherein said load cables are connected to a respective arm at a point thereon to produce unequal leverage about said axis of rotation with said respective drawstring segment, and to act oppositely therefrom to produce an opposing torque.

10. The cross bow according to claim 9 wherein a pair of load cables are arranged connected at one end straddling each of said variable leverage devices and at the other end to a respective prod tip, and wherein said means for mounting each of said variable leverage devices to said stock comprises a pair of anchor cables straddling each of said variable leverage devices and each cable of said pair of anchor cables connected at one end to said stock and the other end to said respective variable leverage device at the center of rotation thereof.

11. The cross bow according to claim 2 wherein each of said rotary variable leverage devices comprises lever arm pairs, each including a first lever arm pivotally mounted on one end to said stock, and at least one load cable connected at an intermediate point on each of said first respective lever arm and to a respective prod tip and further comprises a second lever arm pivotally mounted at one end to the other end of said first lever arm, each of said drawstring segments connected to the other end of said second lever arm, a pair of tension members, each extending between said stock and an intermediate point on a respective one of said second lever arms;

each of said first lever arms extending away from said stock member and each of said second lever arms extending inwardly and forwardly towards said stock member and prod, with said drawstring undrawn, each of said drawstring segments passing around said connected ends of the respective first and second lever arms, to the free end of said second lever arm whereby said second lever arm is caused to rotate outwardly as said drawstring is drawn and said prod tips are flexed as said first lever arm is rotated by the force exerted by said tension of said connected load cable induced by rotation of said first lever arm acting through said second lever arm.

12. The cross bow according to claim 1 further including a slider slidably mounted in said track, and wherein said drawstring is fastened to said slider to prevent lateral relative movement therebetween.

13. The cross bow according to claim 12 wherein said track is located in a plane parallel to the plane of said prod, and wherein said slider further includes an upwardly extending projection, said stock member further including a bolt track slot receiving said projection; whereby said drawstring moves in the same plane as said prod.

14. The cross bow according to claim 13 wherein said slider includes pin means adapted to be received in the tail end of the bolt and the head end of the bolt rests on a bolt track mounted adjacent said forward end of said stock.

15. The cross bow according to claim 1 wherein said track is located in a plane parallel to the plane of said prod, whereby said drawstring moves in a plane that is parallel to the plane of said prod flexing.

16. The prod member according to claim 1 wherein said pivot means for said prod includes a clevis fixed to the forward end of said stock member, a mounting bracket secured to the midpoint of said prod and received within said clevis, and a quick release pin received into said clevis and mounting bracket to provide said pivotal mounting of said prod on said stock member.

17. The prod member according to claim 1 wherein said pivot means for mounting said prod includes a quick release attachment means and shock absorber means allowing limited forward movement of said prod away from said stock member when said drawstring is released;

whereby the recoil shock to the system is absorbed and the reflexing of said prod ends is minimized.

* * * * *